US006494446B1

(12) United States Patent
Tomiyama et al.

(10) Patent No.: US 6,494,446 B1
(45) **Date of Patent: *Dec. 17, 2002**

(54) PAPER FEEDER

(75) Inventors: Katsuya Tomiyama, Tokyo; Junichi Ochiai, Kanagawa, both of (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/534,088

(22) Filed: Mar. 23, 2000

(30) Foreign Application Priority Data

Mar. 24, 1999 (JP) ..... 11-079652

(51) Int. Cl.[7] ..... B65H 3/40; B65H 3/12
(52) U.S. Cl. ..... 271/91; 271/95
(58) Field of Search ..... 271/91, 92, 94, 271/95; 399/8–23, 107–126; 270/58.01–58.34; 222/2–7, 39–50, 99–106

(56) References Cited

U.S. PATENT DOCUMENTS 2,952,457 A * 9/1960 Fliegner ..... 271/12 X
3,126,199 A * 3/1964 Rosoff ..... 271/12 X
3,279,786 A * 10/1966 Fliegner ..... 271/12 X
3,599,967 A * 8/1971 Rapparlle ..... 271/12 X
5,429,347 A * 7/1995 Leonard ..... 271/94

FOREIGN PATENT DOCUMENTS

| | | |
|---|---|---|
| JP | 62-59637 | 4/1987 |
| JP | 1-236154 | 9/1989 |
| JP | 1-261130 | 10/1989 |
| JP | 8-133494 | 5/1996 |
| JP | 2604382 | 1/1997 |
| JP | 10-35950 | 2/1998 |
| JP | 10-194491 | 7/1998 |

* cited by examiner

*Primary Examiner*—Donald P. Walsh
*Assistant Examiner*—Kenneth W. Bower
(74) *Attorney, Agent, or Firm*—Foley & Lardner

(57) ABSTRACT

A paper feeder includes a conveyor for conveying a single paper fed from the upstream side to the downstream side along a transport path while sucking the paper. A suction mechanism faces the conveyor for holding another paper fed together with the above paper by suction. A moving device moves the suction mechanism in a direction perpendicular to a direction of paper conveyance. The paper feeder is capable of accurately feeding various kinds of papers without regard to their thickness or size and delivering even a paper fed together with another paper to a transport path without discharging it to the outside.

28 Claims, 7 Drawing Sheets

PAPER FEEDER

BACKGROUND OF THE INVENTION

The present invention relates to a paper feeder and more particularly to a paper feeder capable of accurately feeding various kinds of papers including mails of regular and irregular sizes one by one.

Generally, a paper feeder for feeding papers one by one includes a two-paper separating mechanism. Usually, the two-paper separating mechanism is constructed such that when a one-paper pickup mechanism located upstream of the two-paper separating mechanism fails to separate mails of regular size, the two-paper separating mechanism separates the mails delivered thereto in an overlapping condition. This kind of paper feeder is taught in, e.g., Japanese Patent Laid-Open Publication No. 1-236154. Specifically, the two-paper separating mechanism includes two suction mechanisms facing each other with the intermediary of a transport path. Two branch transport paths extend from the downstream end of the suction mechanisms in the direction of mail transport. Sensors are located on the branch transport paths, and each senses a mail being conveyed along the associated transport path. When two mails are respectively conveyed along the two branch transport paths, one of them is collected in a box.

However, to separate two papers by suction, the clearance between each suction mechanism and a mail must be small enough for suction to sufficiently act on the mails e.g., 5 mm or so. Such a clearance does not allow thick mails to pass therethrough because the suction mechanisms are fixed in place.

Further, mails separated and collected in the box must be fed and separated all over again. In addition, if an adhesive mail is conveyed for one reason or another, two mails cannot be separated from each other indefinitely.

Technologies relating to the present invention are also disclosed in, e.g., Japanese Utility Model Laid-Open Publication No. 62-59637, Japanese Patent Laid-Open Publication Nos. 1-261130, 8133494 and 10-194491, and Japanese Patent No. 2,604,382.

SUMMARY OF THE INVENTION

It is therefore an object of the present invention to provide a paper feeder capable of surely feeding various kinds of papers without regard to their size, which may be regular or irregular.

It is another object of the present invention to provide a paper feeder with an enhanced processing ability that does not discharge separates papers to the outside.

A paper feeder of the present invention includes a conveyor for conveying a single paper fed from the upstream side to the downstream side along a transport path while sucking the paper. A suction mechanism faces the conveyor for holding another paper fed together with the above paper by suction. A moving device moves the suction mechanism in a direction perpendicular to a direction of paper conveyance.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
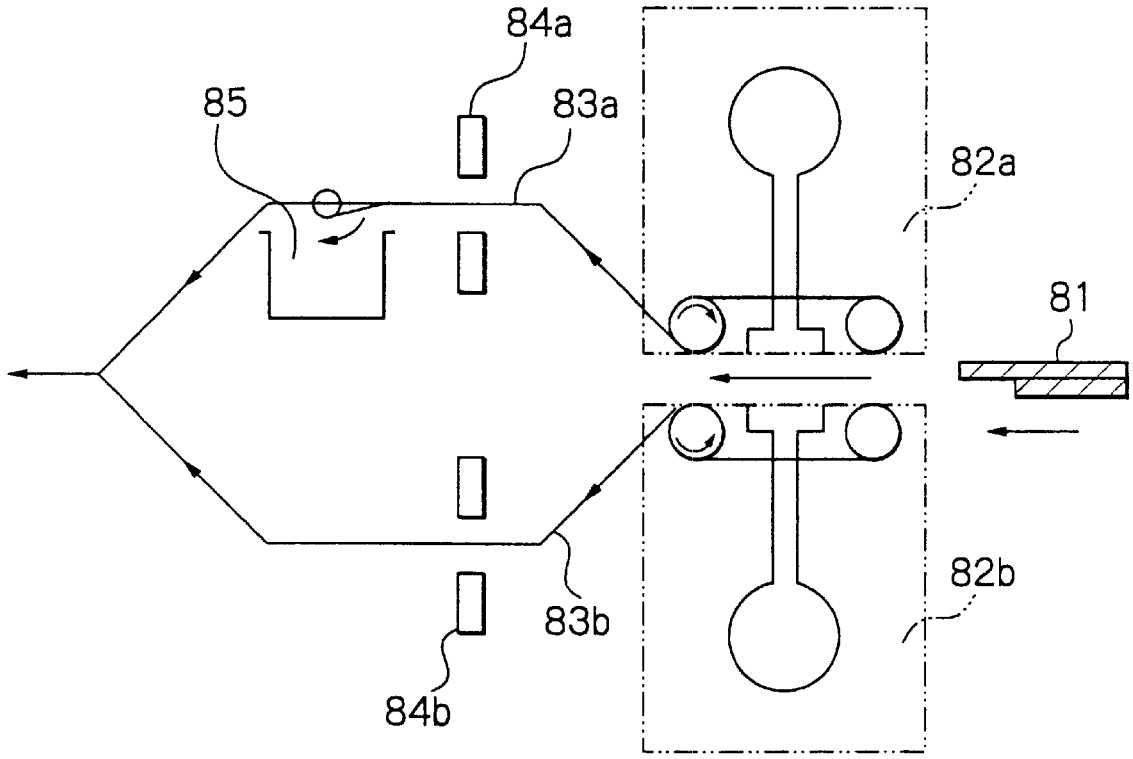
Fig. 1 PRIOR ART
FIG. 1 is a view showing a two-paper separating mechanism included in a conventional paper feeder.

To better understand the present invention, brief reference will be made to the sheet feeder disclosed in Japanese Patent Laid-Open Publication No. 1-236154 mentioned earlier as prior art. FIG. 1 shows the sheet feeder, particularly a two-paper separating mechanism included therein. As shown, the two-paper separating mechanism includes two suction mechanisms 82*a* and 82*b* facing each other with the intermediary of a transport path. A mail or mails 81 passed through a one-paper pickup mechanism, not shown, is conveyed to the suction mechanisms 82*a* and 82*b* along the above transport path. Two branch transport paths 83*a* and 83*b* extend from the downstream end of the suction mechanisms 82*a* and 82*b,* respectively, in the direction of mail transport. Sensors 84 and 84*b* are respectively located on the branch transport paths 83*a* and 83*b,* and each senses the mail 81 being conveyed along the transport path 83*a* or 83*b.* When two mails 81 are respectively conveyed along the transport paths 83*a* and 83*b,* the mail 81 conveyed along the transport path 83*a* is collected in a box 85.

In operation, the suction mechanisms 82*a* and 82*b* each perform an operation for separating the mail 81 by suction. The mail 81, conveyed alone and separated by the suction mechanism 82*a* or 82*b,* is delivered to the branch transport path 83*a* or 83*b.* If two mails 81 are conveyed together and separated from each other by the suction mechanisms 82*a* and 82*b,* they are respectively delivered to the branch transport paths 83*a* and 83*b.* When one of the sensors 84*a* and 84*b* senses the mail 81, the mail 81 is continuously delivered to the downstream side alone. When both the sensors 84 and 84*b* sense the mails 81, the mail 81 on the transport path 83*a* is collected in the box 85 while the mail on the transport path 83*b* is delivered to the downstream side.

However, a problem with the above paper feeder is that the suction mechanisms 82*a* and 82*b* are fixed in place. Generally, the two-paper separating mechanism is constructed to separate two papers passed through the one-paper pickup mechanism without being separated. To separate two papers by suction, the clearance between each suction mechanism 82*a* or 82*b* and the mail 81 must be small enough for suction to sufficiently act on the mail 81, e.g., 5 mm or so. Such a clearance does not allow thick mails to pass therethrough because the suction mechanisms 82*a* and 82*b* are fixed in place.

Another problem is that the mails 81 collected in the box 85 must be fed and separated all over again. In light of this, an arrangement may be made such that when two mails 81 are conveyed together, the feed and conveyance of the mail 81 at the upstream side is interrupted. This, however, is difficult to practice because the entire arrangements between the suction mechanisms 82*a* and 82*b* and the sensors 84*a* and 84*b* must be sharply deactivated. While the box 85 allows the above arrangements to operate without any interruption, repeating the feed and separation all over again is not desirable from the efficiency standpoint. Moreover, if an adhesive mail is conveyed for one reason or another, two mails cannot be separated from each other indefinitely.

Figure 2:
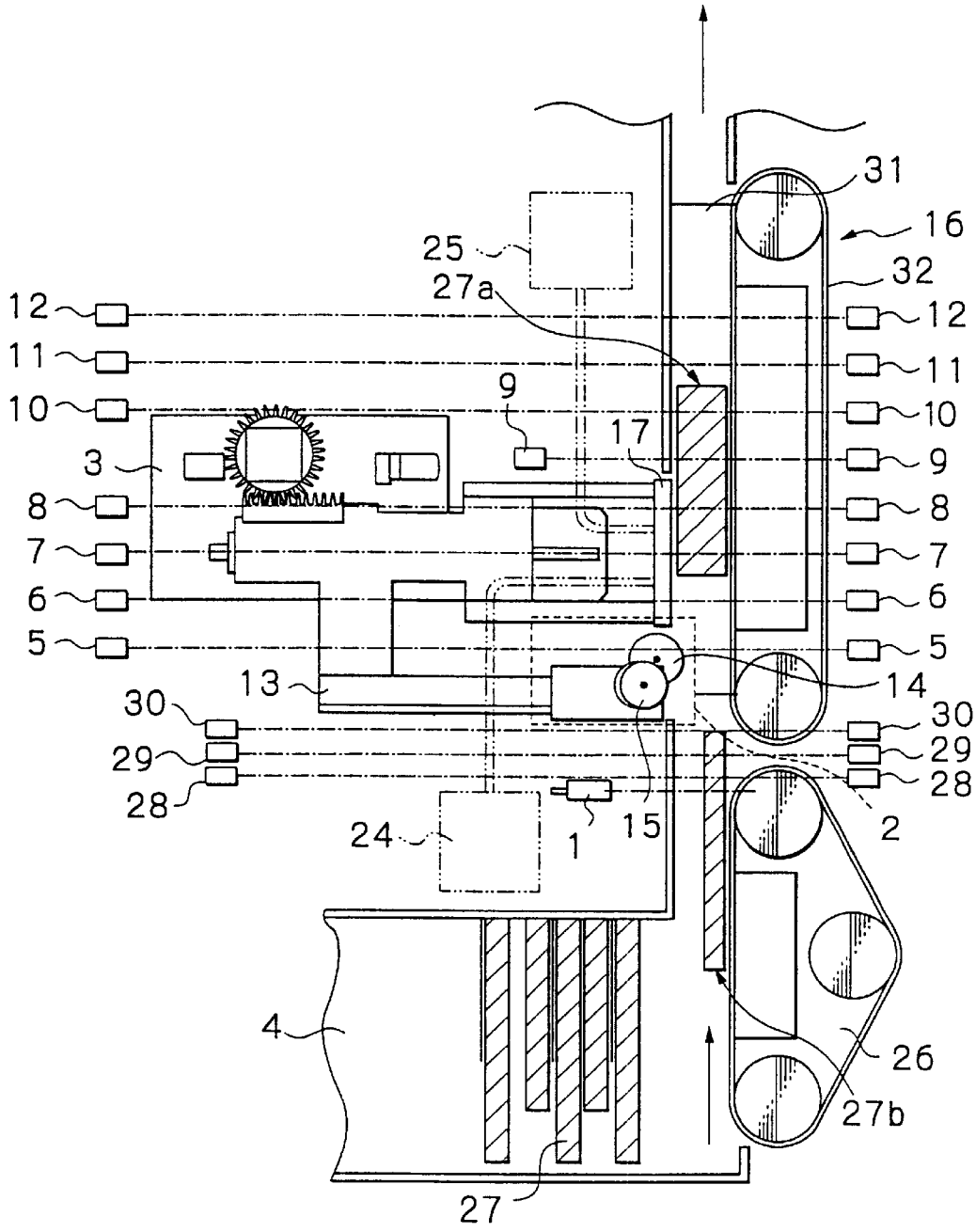
FIG. 2 is a top view showing a paper feeder embodying the present invention.

Referring to FIG. 2, a paper feeder embodying the present invention is shown. As shown, the paper feeder is generally made up of a feeding section 4, a thickness measuring section 1, a separating section 3, a conveyor 16 and a pinch roller section 2 sequentially arranged on a transport path along which papers 27 move in an upright position from the upstream side to the downstream side. The feeding section 4 includes a one-paper pickup mechanism 26. The thickness measuring section 1 measures the thickness of a paper 27*b* picked up by the mechanism 26. The separating section 3 and conveyor 16 face each other with the intermediary of the transport path. The pinch roller section 2 is located downstream of the thickness measuring section 1, but upstream of the separating section 3, for pressing the paper 27*b* against the conveyor 16.

The feeding section 4 with the one-paper pickup mechanism 26 feeds the papers 27 to the paper feeder of the illustrative embodiment while separating them one by one. The thickness measuring section 1 is positioned downstream of the mechanism 26 and faces the mechanism 26 with the intermediary of the transport path. The thickness measuring section 1 continuously measures the thicknesses of the papers 27*b* sequentially picked up. In the illustrative embodiment, the section 1 is implemented by a laser displacement sensor. In FIG. 2, the section 1 is shown as sensing the thickness of the paper 27*b*.

The conveyor 16 includes a bottom belt 31 delimiting the bottom of the transport path and a suction belt 32 perpendicular to the bottom belt 31. While the bottom belt 31 contacts the bottom edge of the paper 27*a* and conveys it by friction, the suction belt 32 sucks one major surface or side of the paper 27*a*. As a result, the paper 72*a* is conveyed in an upright position. To surely deliver a single paper 27 to the downstream side, it is necessary to determine and control the conveying condition of the conveyor 16 or the paper separating condition. In the illustrative embodiment, sensors 5 through 12 and sensors 28 through 30 are sequentially arranged along the conveyor 16 from the upstream side to the downstream side. The sensors 5 through 12 and 28 through 30 respectively face each other at a preselected distance for sensing the papers 27 being conveyed by the conveyor 16. In the illustrative embodiment, the sensors 5 through 12 and 28 through 30 are implemented by photoelectric sensors. The outputs of the sensors 5 through 12 and 28 through 30 show a paper conveying condition and therefore whether or not paper separation is necessary.

The pinch roller section 2 is made up of an arm 13, a roller 14, and a rotary solenoid 15. The pinch roller section 2 is so positioned as to press the upright paper 27*b* brought to the suction belt 29 of the conveyor 16 against the suction belt 29. The arm 13 interlocks the pinch roller section 2 to the separating section 3. When the rotary solenoid 15 rotates a preselected angle, it moves the roller 14 into pressing contact with the suction belt 32 with the intermediary of the paper 27*b*.

The separating section 3 includes a suction mechanism 17. A vacuum valve 24 and an air blow valve 25 are communicated to the suction mechanism 17 and selectively opened or closed to control pressure inside the mechanism 17.

Figure 3A:
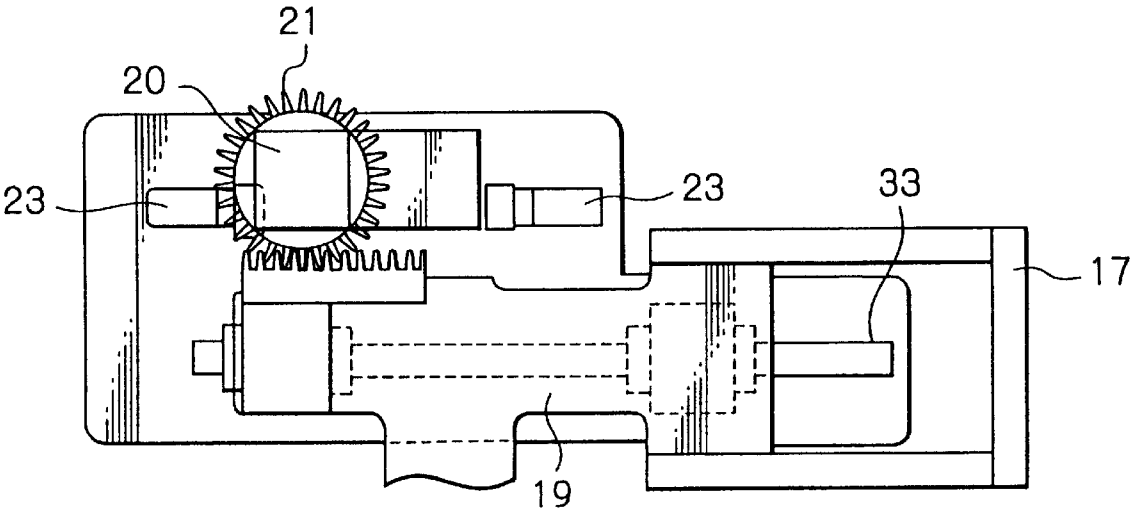
FIGS. 3A and 3B are respectively a top view and a side elevation showing essential part of the illustrative embodiment.
Figure 3B:
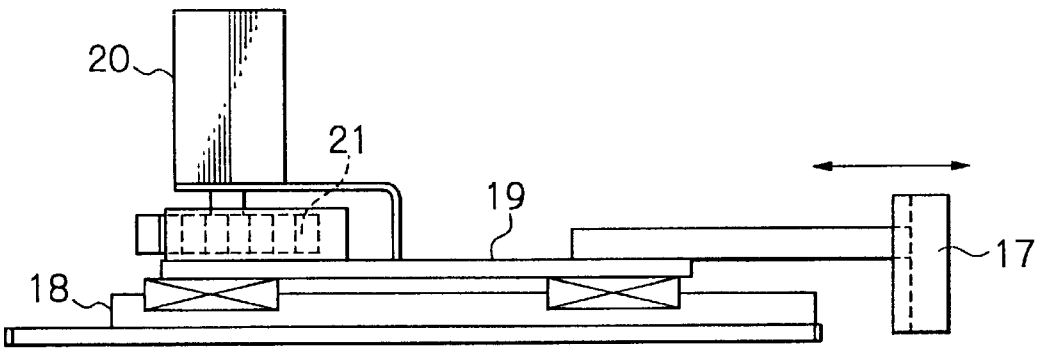

As shown in FIGS. 3A and 3B in detail, the separating section 3 includes a servomotor 20. A base 19 is driven by the servomotor 20 and linearly movable back and forth on a guide shaft 33 positioned beneath the base 19. The suction mechanism 17 is mounted on the front end of the base 19 for sucking the papers 27. A bearing 18 is also positioned beneath the base 19 and rotatably supports the above guide shaft 33. A gear 21 is positioned at one side of the base 19 for transferring the operation of the servomotor 20 to the base 19. Limit sensors 23 are also positioned at one side of the base 19 for limiting the movable range of the base 19. The servomotor 20 is positioned above the gear 21. In this configuration, the servomotor 20 causes the base 19 to linearly move forward or rearward within the above range so as to locate the suction mechanism 17 at an adequate position.

Figure 4A:
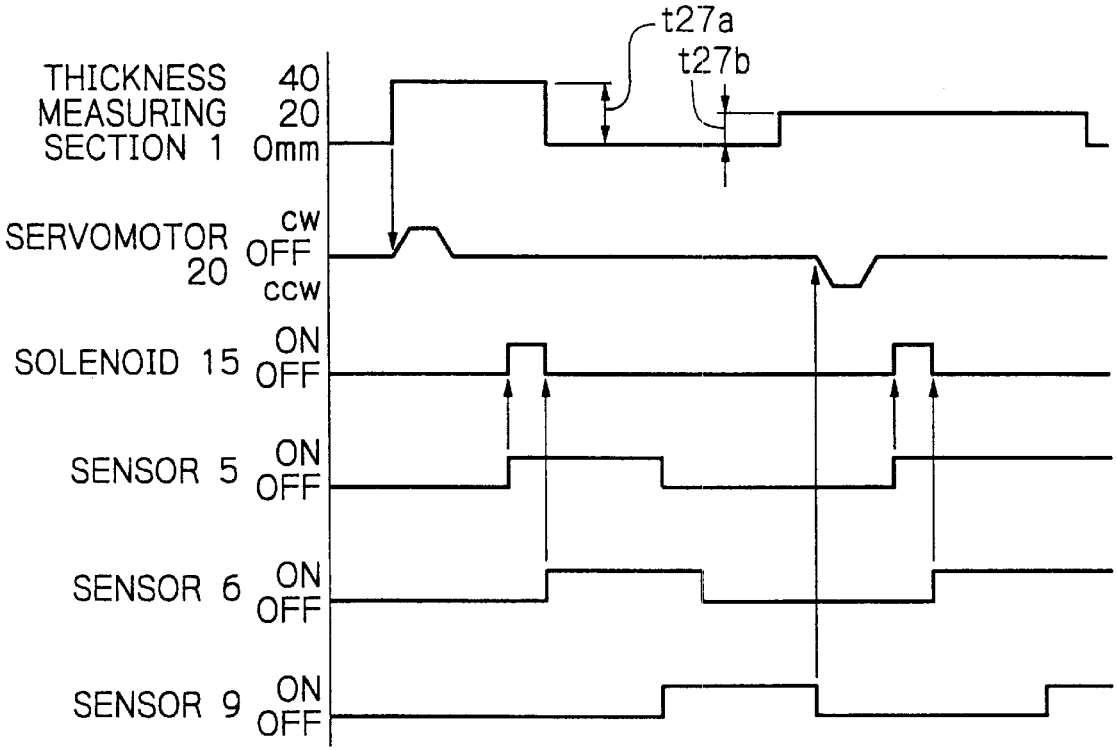
FIGS. 4A and 4B are timing charts demonstrating a specific operation of the illustrative embodiment.

In operation, the thickness measuring section 1 measures the thickness of the paper delivered from the feeding section 4 to the one-paper pickup mechanism 26. The servomotor 20 is driven in accordance with the measured thickness in order to locate the suction mechanism 17 at a position spaced from the surface of the paper 27 by 1 mm to 5 mm. The pinch roller section 2 is operated together with the suction mechanism 17. Specifically, as shown in FIG. 4A, when the output of the sensor 5 goes high (ON), the rotary solenoid 15 is energized to cause the roller 14 to press the paper 27 against the suction belt 32 of the conveyor 16, allowing the suction belt 32 to suck the paper 27. When the output of the sensor 6 downstream of the sensor 5 goes high (ON), the roller 14 is moved away from the suction belt 32 so as to stop pressing the paper 27.

Figure 4B:
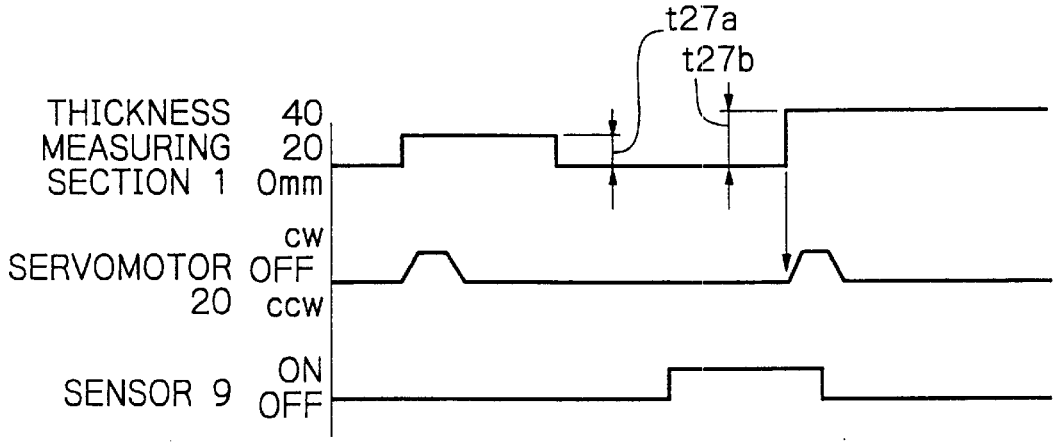

When a single paper 27 is fed alone, the conveyor 16 conveys it to the downstream side. As shown in FIG. 2, assume that the paper 27*b* has a thickness t27*b* measured by the thickness measuring section 1 smaller than the thickness t27*a* of the paper 27*a* preceding the paper 27*b* and being conveyed to the downstream side. Then, the sensor 9 goes low (OFF) when the trailing edge of the paper 27*a* moves away from the sensor 9. In response, the servomotor 20 is driven counterclockwise to advance the suction mechanism 17 to a position spaced from the surface of the paper 27*b* by 1 mm to 5 mm in accordance with the thickness t27*b* of the paper 27*b*. Conversely, assume that the thickness t27*b* of the following paper 27*b* is greater than the thickness t27*a* of the preceding paper 27*a*. Then, as shown in FIG. 4B, just after the sensing section 1 has sensed the thickness t27*b*, the servomotor 20 is driven clockwise to retract the suction mechanism 17 to a position spaced from the surface of the paper 27*b* by 1 mm to 5 mm.

Figure 5:
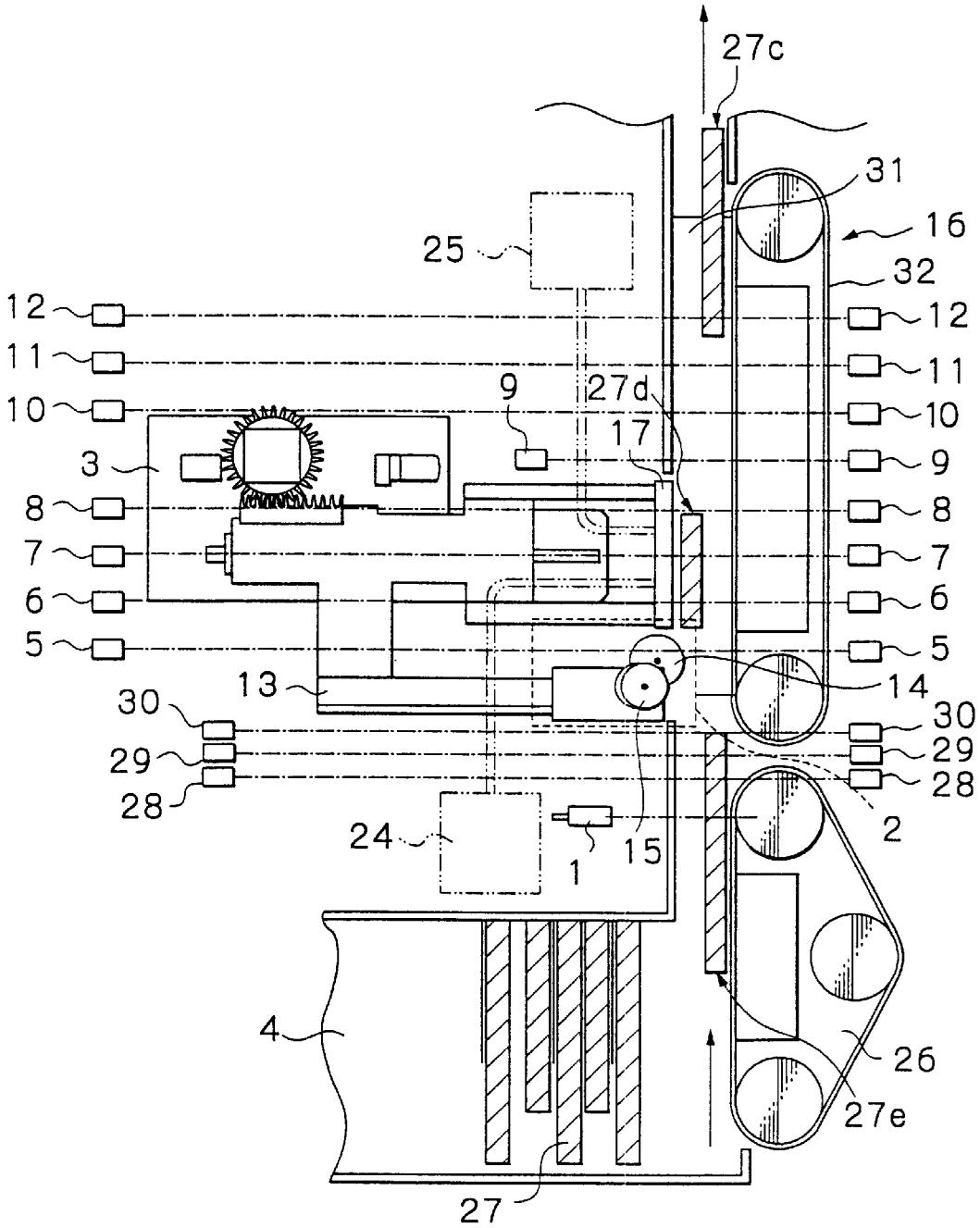
FIG. 5 is a top view showing two papers fed together, but separated from each other, in the illustrative embodiment.

On the other hand, assume that two overlapping papers are fed together. Then, as shown in FIG. 5, a paper 27*d* fed together with a paper 27*c* and closer to the suction mechanism 17 than the paper 27*c* is separated from the paper 27*c* by the mechanism 17. The other paper 27*c* is sucked by the conveyor 16 and conveyed to the downstream side thereby. The paper 27*d* is held stationary by the suction mechanism 17.

Figure 6:
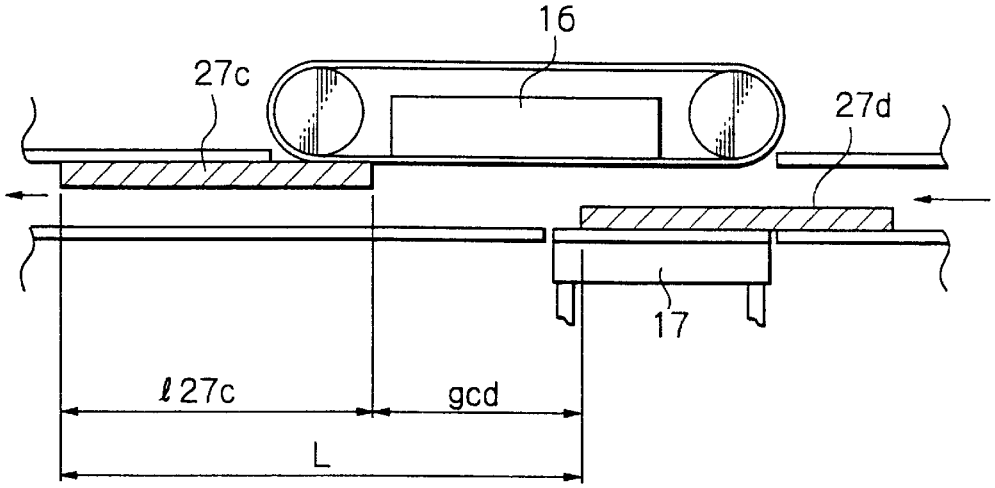
FIG. 6 is a top view showing how a separated paper is again fed in the illustrative embodiment.
Figure 7:
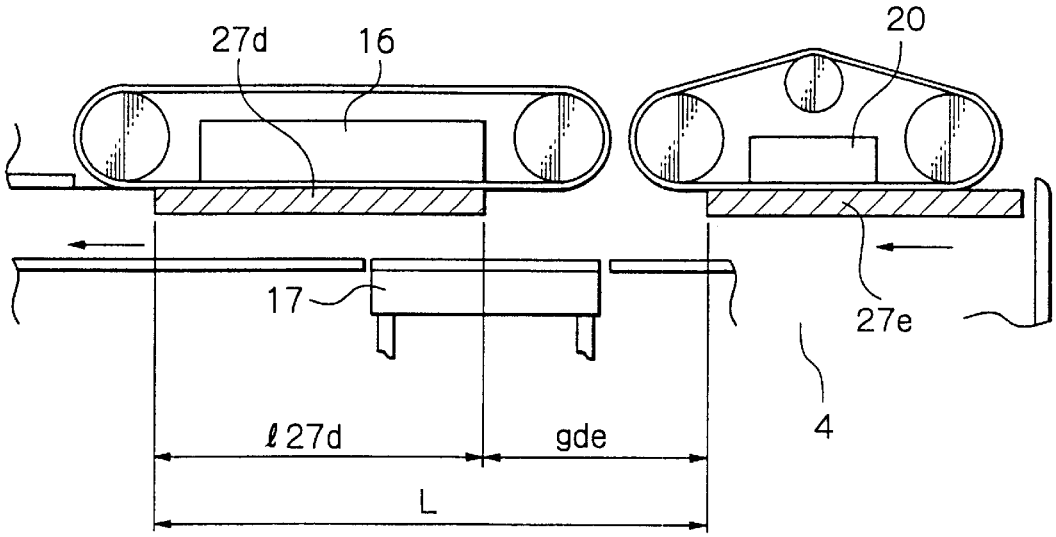
FIG. 7 is a top view showing a condition in which the feed of a paper is resumed in the illustrative embodiment.
Figure 8:
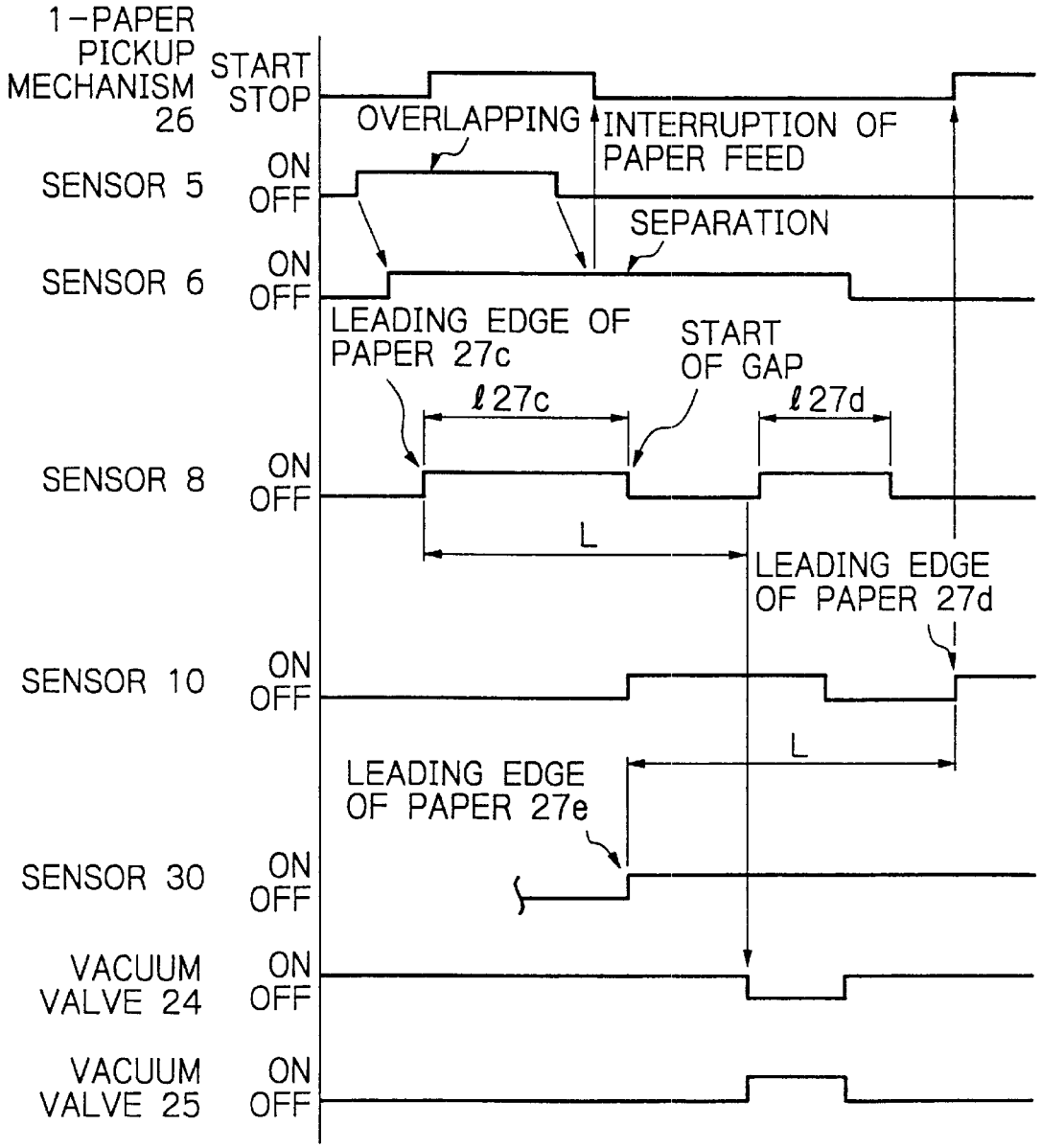
FIG. 8 is a timing chart demonstrating another specific operation of the illustrative embodiment.

FIGS. 6 and 7 show the conveyance of the above papers 27*c* and 27*d* more specifically. As shown, assume that the papers 27*c* and 27*d* have lengths 127*c* and 127*d*, respectively, and that the papers 27*c* and 27*d* are spaced from each other by a gap gcd while the paper 27*d* is spaced from a paper 27*e* following it by a gap gde. As shown in FIG.

8, assume that after the sensor 6 has sensed the trailing edge of the paper 27*c* or 27*d,* the sensor 6 does not sense it. Then, it is determined that the papers 27*c* and 27*d* are fed together. In this case, the feed of the paper 27*e* from the feeding section 4 is interrupted; the leading edge of the paper 27*e* is sensed by any one of the sensors 28 through 30.

Subsequently, as shown in FIG. 6, when the distance between the leading edge of the paper 27*c* sensed by the sensor 6 and that of the paper 27*d* (127*c*+gcd) reaches a preselected value L, the vacuum valve 27 and air flow valve 25 communicated to the suction mechanism 17 are closed and opened, respectively. As a result, the pressure inside the suction mechanism 17 is switched from negative to positive, causing the mechanism 17 to stop sucking the paper 27*d.* At the same time, the suction mechanism 17 is moved toward the conveyor 16 in order to deliver the paper 27*d.* As shown in FIG. 7, when the distance between the leading edge of the paper 27*d* being conveyed by the conveyor 16 and that of the paper 27*e* waiting at the feeding section 4 (127*d*+gde) reaches the preselected value L, the one-paper pickup mechanism 26 is again activated to feed the paper 27*e* from the feeding section 4.

In summary, it will be seen that the present invention provides a paper feeder capable of accurately feeding various kinds of papers without regard to their thickness or size and delivering even a paper fed together with another paper to a transport path without discharging it to the outside.

Various modifications will become possible for those skilled in the art after receiving the teachings of the present disclosure without departing from the scope thereof.

What is claimed is:

1. A paper feeder comprising:

a conveyor for conveying a single paper fed from an upstream side to a downstream side along a transport path while sucking said single paper;

a suction mechanism facing said conveyor for holding another paper fed together with said single paper by suction; and moving means for moving said suction mechanism or conveyor to establish a gap between all areas of the conveyor and the suction mechanism; independent of the paper being conveyed.

2. A paper feeder as claimed in claim 1, wherein said suction mechanism comprises a front plate formed with at least one suction port, a suction chamber, and pressure control means for controlling a pressure in said vacuum chamber.

3. A paper feeder as claimed in claim 2, further comprising thickness measuring means positioned upstream of said suction mechanism in the direction of paper conveyance for measuring a thickness of the paper, wherein said suction mechanism is moved by a distance based on the thickness measured by said thickness measuring means.

4. A paper feeder as claimed in claim 3, further comprising sensing means arranged along said transport path for sensing the paper being conveyed, wherein when said sensing means has sensed the paper sucked by said suction mechanism, a conveyance of a paper from the upstream side is interrupted while said pressure control means causes said suction mechanism to return the paper sucked to said conveyor.

5. A paper feeder as claimed in claim 4, wherein said sensing means comprises a plurality of sensors arranged at preselected intervals along said transport path.

6. A paper feeder as claimed in claim 5, wherein said front plate of said suction mechanism is formed with a number of channels.

7. A paper feeder as claimed in claim 6, further comprising a pinch roller mounted on said moving means at a position upstream of said suction mechanism for guiding the paper toward said conveyor, said pinch roller being movable into and out of contact with said conveyor.

8. A paper feeder as claimed in claim 1, further comprising thickness measuring means positioned upstream of said suction mechanism in the direction of paper conveyance for measuring a thickness of the paper, wherein said suction mechanism is moved by a distance based on the thickness measured by said thickness measuring means.

9. A paper feeder as claimed in claim 8, further comprising sensing means arranged along said transport path for sensing the paper being conveyed, wherein when said sensing means has sensed the paper sucked by said suction mechanism, a conveyance of a paper from the upstream side is interrupted while said pressure control means causes said suction mechanism to return the paper sucked to said conveyor.

10. A paper feeder as claimed in claim 9, wherein said sensing means comprises a plurality of sensors arranged at preselected intervals along said transport path.

11. A paper feeder as claimed in claim 10, wherein said front plate of said suction mechanism is formed with a number of channels.

12. A paper feeder as claimed in claim 11, further comprising a pinch roller mounted on said moving means at a position upstream of said suction mechanism for guiding the paper toward said conveyor, said pinch roller being movable into and out of contact with said conveyor.

13. A paper feeder as claimed in claim 1, further comprising sensing means arranged along said transport path for sensing the paper being conveyed, wherein when said sensing means has sensed the paper sucked by said suction mechanism, a conveyance of a paper from the upstream side is interrupted while said pressure control means causes said suction mechanism to return the paper sucked to said conveyor.

14. A paper feeder as claimed in claim 13, wherein said sensing means comprises a plurality of sensors arranged at preselected intervals along said transport path.

15. A paper feeder as claimed in claim 14, wherein said front plate of said suction mechanism is formed with a number of channels.

16. A paper feeder as claimed in claim 15, further comprising a pinch roller mounted on said moving means at a position upstream of said suction mechanism for guiding the paper toward said conveyor, said pinch roller being movable into and out of contact with said conveyor.

17. A paper feeder as claimed in claim 1, wherein said suction mechanism comprises a front plate wherein said front plate is formed with a number of channels.

18. A paper feeder as claim 17, further comprising a pinch roller mounted on said moving means at a position upstream of said suction mechanism for guiding the paper toward said conveyor, said pinch roller being movable into and out of contact with said conveyor.

19. A paper feeder as claimed in claim 1, further comprising a pinch roller mounted on said moving means at a position upstream of said suction mechanism for guiding the paper toward said conveyor, said pinch roller being movable into and out of contact with said conveyor.

20. A paper feeder comprising:

a conveyor for conveying items from a group of items along a transport path;

a first suction mechanism for holding said items against the conveyor;

a second suction mechanism operating to bias the items away from the conveyor:

a device for moving the second suction mechanism or cpnveyor to establish a gap between all areas of the conveyor and the second suction mechanism independent of the item being conveyed.

21. A paper feeder as claimed in claim 20, wherein the device moves the second suction mechanism in a direction that is perpendicular to the transport path.

22. A paper feeder as claimed in claim 21, wherein the second suction mechanism comprises a vacuum valve and in air flow valve.

23. A paper feeder as claimed in claim 22, wherein the second suction mechanism has a front plate wherein the front plate is formed with multiple channels.

24. A paper feeder as claimed in claim 20, wherein the items conveyed are generally flat and the paper feeder further comprises a sensing means for measuring the thickness of the flat items being conveyed.

25. A paper feeder as claimed in claim 24, wherein the second suction mechanism is moved closer to the conveyor or further away from the conveyor according to the measured thickness of the flat items being conveyed.

26. A paper feeder as claimed in claim 20, wherein the items conveyed are generally flat and the second suction mechanism secures a first flat item by suction, overcoming the suction of the first suction mechanism, if that first flat item overlaps a second flat item that is being conveyed together with the first flat item, wherein the second flat item is closer to the conveyor than the first flat item, and wherein the first flat item and the second flat item are thereby separated.

27. A paper feeder as claimed in claim 26, further comprising a second sensing means for sensing whether the first flat item and the second flat item have been conveyed overlapping one another and delaying the conveyance of a third flat item until the first and second overlapping flat items have been separated and conveyed.

28. A paper feeder as claimed in claim 27, wherein the second sensing means causes the second suction mechanism to release the first flat item to the conveyor after the second flat item has been conveyed along the transport path.

* * * * *